United States Patent [19]

Leverich

[11] 4,323,610

[45] Apr. 6, 1982

[54] FOOT PROTECTOR FOR FURNITURE

[76] Inventor: George C. Leverich, 4905 N. Topping, Kansas City, Mo. 64119

[21] Appl. No.: 140,149

[22] Filed: Apr. 14, 1980

[51] Int. Cl.[3] ..... B32B 1/08; B32B 3/02

[52] U.S. Cl. ..... 428/68; 428/36; 428/80; 428/81; 428/82; 428/99; 428/100

[58] Field of Search ..... 16/34, 42 R; 182/108, 182/111; 248/188.9, 345.1, 346.1, 188.8; 297/463; 428/36, 80, 81, 82, 99, 100, 127, 128, 129, 136, 68

[56] References Cited

U.S. PATENT DOCUMENTS

| | | | |
|---|---|---|---|
| 1,420,602 | 6/1922 | Wujek | 16/42 R |
| 1,486,267 | 3/1924 | Salomon | 182/108 |
| 1,591,550 | 7/1926 | Rosenthal | 297/463 |
| 1,781,951 | 11/1930 | Jantzen | 16/42 T |
| 2,527,116 | 10/1950 | Chapman | 428/136 |
| 2,909,128 | 9/1959 | Boham et al. | 182/108 |
| 2,975,468 | 3/1961 | McClellan | 16/42 R |
| 3,144,236 | 8/1964 | Clanin | 248/346.1 |
| 3,662,856 | 5/1972 | D'Amico et al. | 182/108 |
| 3,763,858 | 10/1973 | Buese | 428/311 |
| 3,941,159 | 3/1976 | Toll | 428/36 |
| 3,993,163 | 11/1976 | Barrett | 182/108 |
| 4,009,735 | 3/1977 | Pinsky | 428/36 |
| 4,117,782 | 10/1978 | Cahill | 248/345.1 |
| 4,244,057 | 1/1981 | Burnham | 428/99 |

*Primary Examiner*—William J. Van Balen

*Attorney, Agent, or Firm*—Thomas M. Scofield

[57] ABSTRACT

Protective devices for the legs and feet of furniture and equipment items; removable, resilient, protective enclosure constructions for the lower, supporting legs of furniture and equipment, for use particularly in house areas that are well traveled at night; surrounding and encircling sleeves of protective but loose and resilient materials to guard certain furniture and equipment feet, legs and supports from foot and toe impacts incident upon walking through darkened house areas; devices which operate to protect people's feet and toes from striking furniture and bed supports and the like and, simultaneously, protect the said feet and supports from impact; snap-on and removable guards for machinery and apparatus support legs in work or industrial areas, as well as homes, which protect both people's feet and the device's legs.

14 Claims, 9 Drawing Figures

FOOT PROTECTOR FOR FURNITURE

BACKGROUND OF THE INVENTION

In household living it is common for one or more occupants of a house to traverse bedroom or the living areas at night or under unlighted circumstances for which the occupants' feet are inadequately protected. Specifically, persons' feet may be bare or else be covered by nonprotective cloth slippers, thong sandals or the like. For example, an adult before going to bed, or in the process of going to bed, may switch off the room light and walk in a darkened room through a considerable room area to reach the bed. In another instance, a father or mother may rise from bed in the dark to attend a child. The appearance of a late caller, a telephone call, the need for a visit to the bathroom or a desire for a late snack may cause occupants of the house to traverse one or more bedrooms, bathrooms and living areas inadequately shod and with insufficient light.

In such cases, it is not uncommon for the said occupant to strike a toe or any part of the foot against a leg of a chair, table or bed. A particular offender, and one which may cause serious injury, such as a sprain or broken toe, are the caster supports for a Hollywood type bed. While injury to a particular furniture item is less of a problem than a painful toe strike, nevertheless, an early warning contact device might also serve to protect a valuable piece of furniture or parts thereof, particularly if such has been moved from an accustomed position in the house.

The situation described is not unique to households, however, or living or bedroom areas thereof. Certain kitchen or basement equipment may well have support beams, casters thereof for moving same across surface, or legs offering hazard to feet and toes. In fast food restaurants or catering areas at clubs or the like, often waitresses or waiters may be inadequately shod for protection. Such may be the case when food and/or drink is to be carried out into and returned from parking, beach, sand areas, pool areas and the like.

The need for protection to inadequately shod feet with respect to furniture legs, equipment supports, bed casters and the like is well known. The need for protection to furniture legs from the feet and shoes of even a shod person is sometimes also the case. The number of such zones and items to be protected may be considerable in a given household. Accordingly, it becomes a problem to provide adequate protection to the feet of human beings in certain furnished areas of equipment areas and, concomitantly, protection for equipment supports, furniture legs and the like from the feet of humans, all in efficiently simple, cheap, convenient and optionally or readily removable ways.

THE PRIOR ART

Applicant is aware of the following prior art U.S. Pat. Nos. patents directed to resilient shoes or sleeves for the feet of furniture, such as tables, chairs, beds and the like:

Wujek 1,420,602 issued June 20, 1922 for "Shoe For The Legs Of . . . Articles";

Salomon 1,486,267, issued Mar. 11, 1924 for "Attachment For Furniture Legs";

Rosenthal 1,591,550, issued July 6, 1926 for "Removable Foot . . . ";

Jansen 1,781,951, issued Nov. 18, 1930 for "Furniture Shoe".

Applicant is additionally aware of the following U.S. Pat. Nos. directed to protective covers or guards for portions of furniture:

Clanin 3,144,236 "Protector-Type Cover For Furniture Corners", issued Aug. 11, 1964; and Cahill 4,117,782, issued Oct. 3, 1978 for "Guard For Preventing Human Injuries On Impact With Furnishings".

The U.S. Pat. No. to McCalewan 2,975,468 "Self Stabilizing Foot For Retractable Castered Tables", issued Mar. 21, 1961, discloses leveling means of rigid metal for devices having retractable casters.

BRIEF DESCRIPTION OF THE INVENTION

Briefly described, the invention is a cylindrical or frusto-conical sleeve of semi-rigid yet resilient material which is adapted to be removably placed around the legs or feet of furniture, equipment or the like. The device must be of sufficient height that it encircles or encloses the hazardous furniture support to a level several inches above the floor, sufficient that a walking individual's foot, even if lifted several inches above the floor, will contact the guard or device, rather than the portion of the support therebehind. Secondly, this cylindrical or frusto-conical structure must be openable for ready application to and removal from the furniture or equipment support to be protected. In some areas, the supports can be enclosed indefinitely. In others, the safety enclosures will be used only at specific times or brief intervals.

Finally, the device must be of a material which is sufficiently strong and semi-rigid that the applicant's toe, in a barefoot encounter, simply does not push through the protector, without protection, to the support surrounded. On the other hand, it must be resilient enough to yield before the operator's or user's foot so contact with it will not itself injure the user's foot. A certain amount of warning and protection comes from the initial contact with the sleeve which is spaced circumferentially outwardly from the hazardous support. A backup amount of protection and warning comes from the impact of the sleeve against the support itself if the user's foot drives it thereagainst. The latter point, the uniform character of the protector, its substantially smooth surface and its yielding impact upon the support all aid to protect the user's foot. By not being integral with or connected to the object it surrounds, other advantages are obtained.

OBJECTS OF THE INVENTION

A first object of the invention is to provide improved devices for protectively surrounding the feet of furniture pieces, equipment and legged structures in home, commercial and work areas frequently traveled by individuals in unlighted conditions and/or with insufficiently protected feet.

Another object of the invention is to provide cheap, extremely simple, very effective, strong, resilient and long-lived devices for protecting human feet from impact against objects such as bed casters, furniture legs and apparatus supports in home, commercial and work areas.

Another object of the invention is to provide economical and sensible means and devices for protecting the feet of adults, adolescents and children from hazardous, ignored, unseen or hidden furniture, equipment and apparatus legs and supports, which devices may be applied or removed easily and simply by the ordinary housewife.

Another object of the invention is to provide such protective devices which serve not only to warn the approaching foot of an unaware walker in the vicinity, but also protect that foot from pain and harm should it strike the protector and then the support. Yet additionally, the device, as a secondary feature, operates to give warning to human feet of unsuspected furniture or the like presence where impact might mean damage to the furniture or equipment and, additionally, offer some protection to the support as well as the foot of the person in question.

Another object is to provide such devices which need not be integral with or connected to the furniture leg or support to be protected.

Other and further objects of the invention will appear in the course of the following description thereof.

THE DRAWINGS

In the drawings, which form a part of the instant specification and are to be read in conjunction therewith, embodiments of the invention are shown and, in the various views, like numerals are employed to indicate like parts.

Figure 1:
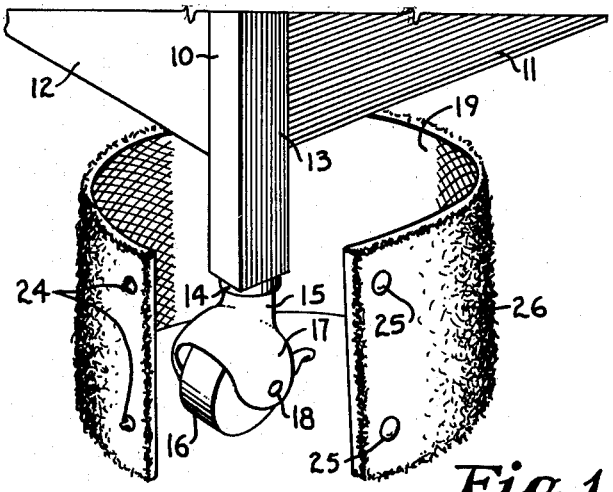
FIG. 1 is a three-quarter perspective view, from above, of one corner leg of a Hollywood type bed having a wheeled caster thereon, with a first form of the protective sleeve invention positioned initially around the depending leg and caster, ready to be snapped to itself.
Figure 2:
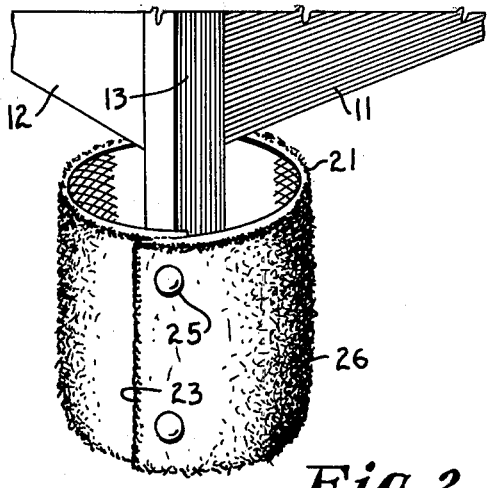
FIG. 2 is a view like that of FIG. 1, but with the device in operating position, completely encircling the bed foot, with the engaging snaps closed.
Figure 3:
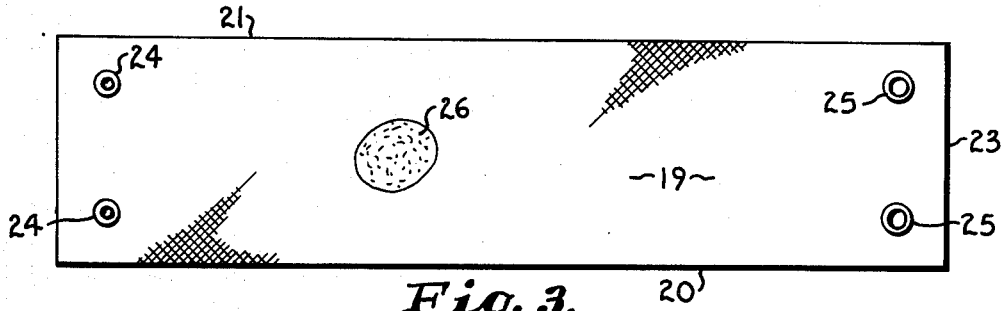
FIG. 3 is a vertical plan view of the outside of the device of FIGS. 1 and 2 extended in flat form.
Figure 4:
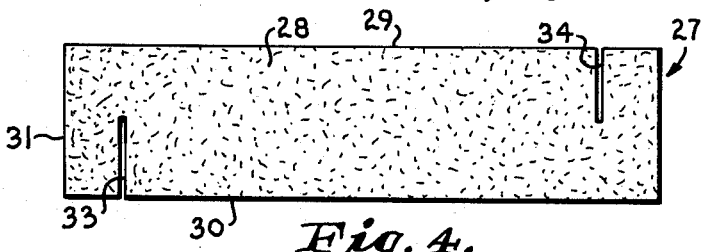
FIG. 4 is a plan view of a modified device having a different attachment means extended in flat form in the manner of the device of FIG. 3.
Figure 6:
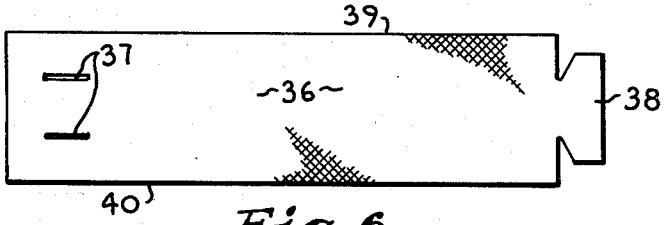

FIG. 6 is a view like those of FIGS. 2 and 4 showing another variation of the cylindrical devices of FIGS. 1–3, inclusive and 4 and 5, illustrating a third manner of connection of the ends of the device to itself.

Figure 5:
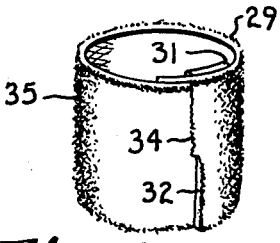
FIG. 5 is a three-quarter perspective view from above of the device in FIG. 4 when assembled.
Figure 7:
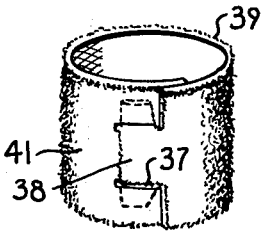

FIG. 7 is a view like those of FIGS. 2 and 5 showing the strip of FIG. 6 assembled.

Figure 8:
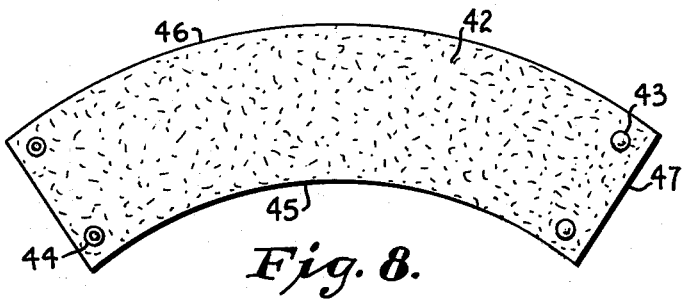
Figure 9:
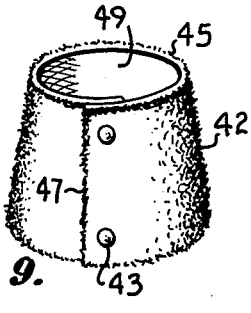

FIG. 8 is a vertical plan view of another variation of the invention extended in flat form, this sleeve of frusto-conical configuration when assembled upon itself as seen in FIG. 9.

FIG. 9 is a three-quarter perspective view from above of the frusto-conical sleeve of FIG. 8 showing the latter assembled and also illustrating a greater height construction than those previously shown.

STRUCTURE AND FUNCTION

Referring first to FIGS. 1 and 2, therein is shown at 10 the base (at one corner) of a typical Hollywood bed having an end structural beam 11 and a side structural beam 12 connected in the usual manner to a vertical leg 13. This leg 13 carries, on its underside, a socket 14 which receives (unseen therein) a shaft from caster 15. A typical cylindrical or ball like wheel 16 is received in the clevis arms 17 of the caster by means of pin or bolt 18.

It may be seen that this typical depending leg construction offers numerous points for a painful hit by a bare toe on a bare foot or a toe through a cloth slipper, etc. These include the support 13 itself, any part of the caster, the wheel of the caster or the like. Anyone who has kicked a roller bed support in the middle of the night in the dark or under a decorative ruffle while moving in even the most innocuous manner around one's bedroom, thereby to sustain an agonizing and painful strike or even injury therefrom needs little further description.

Referring to FIG. 3, wherein is shown the inside face 19 of a cylindrical protector or sleeve. This rectangular elongate length may (in a typical, but not limiting size) have elongate upper and lower edges 20 and 21 of approximately 14 inches and normally vertical end or side edges 22 and 23 of approximately four inches length. Male snap portions 24 fixed through the body of the material are to be engaged with the female snaps 25 whose open inner faces are seen on the illustrated inside face or side of the protector. The bases of the male snaps are seen in FIG. 3.

A very convenient material from which the protector of FIGS. 1–3 may be made is carpet. The base of the carpeting on face 19 gives a rigid, relatively stiff and strong surface which may be jammed against, kicked against or forced against variably shaped devices which may have protrusions thereon or sharp edges, without injuring the protector or deforming it substantially. On the other hand, the outer face 26 of the protector, with the nap of the carpet, is more resilient and absorbent of shock into the individual's foot for protection of the usually more vulnerable foot portion of the human anatomy. On the other hand, as an alternative, the protector can have a resilient side facing inward to the furniture leg or apparatus support, a relatively stiff center portion and an outer, more resilient portion. This would be equivalent to a piece of carpet with nap on each side and a base in the middle. This structure would offer protection to delicate furniture legs, such as antiques, as well as the owner's foot.

At any rate, FIGS. 1 and 2 show the extremely simple method of application of the subject protector to a Hollywood type bed leg, involving merely encircling the piece of carpet here shown around the leg and engaging the male and female snap members 24 and 25 with one another. It is most preferable to have a protector which is not either integral with or connected or connectible in any way with the furniture leg or support structure to be surrounded. In this manner, the protector can be positioned entirely free thereof and may be grazingly struck by a human toe or the like without even contacting the support. Alternatively, such a preliminary strike by a user's foot may permit change of motion to avoid further or harder contact with the furniture leg itself. With the free protector, additionally, a grazing or relatively slight strike against the protector and leg will not necessarily move or knock over a piece of furniture, depending on its sort and mass.

The snap carrying portions (engaged in FIG. 2) may be positioned away from the area of likely strike to protect the furniture if desired (rotated 180° from FIG. 2).

FIGS. 4 and 5 show a variation of the construction of FIGS. 1–3 wherein an elongate piece of protective material of the type described has a different method of interconnecting the ends. Thus, elongate rectangular sheet or strip 27 has outer or outboard face 28, upper and lower edges 29 and 30 and normally vertical side or end edges 31 and 32. Slits 33 and 34 are positioned adjacent ends 31 and 32 and permit an engagement as shown in FIG. 5. As may be seen in FIG. 5, the connection is best made by the free ends 31 of the sleeve being positioned inboard of the outer surface.

FIGS. 6 and 7 show a third modification of the device differing only in the manner of connection. In FIG. 6, the inside surface 36 of the elongate strip of carpeting or analogous material is seen with horizontal paired slits 37 adjacent one end and an end tab 38 on the other end. When the device is wrapped on itself, as may be seen in FIG. 7, the ears of tab 38 are inserted in the slits 37 to again give a cylindrical construction with the padded or more resilient outer face 40 outboard. As previously stated, both the inboard and outboard faces may be resilient, padded, or nap like for both foot and object protection.

Finally, in FIG. 8, there is shown a preferred form of the subject invention, where a frusto-conical (rather than cylindrical) protector or sleeve is provided. This device is advantageous in that the upper edge of the sleeve or protector tends to contact the leg support before the toe of the user will strike same through the sleeve, giving additional warning and additional protection. Conversely, a glancing or slight strike of the user's toe, by both giving warning and perhaps limiting contact with the device, offers greater protection to the leg support inside of the sleeve.

Thus, in FIG. 8, the outer side 42 of the sleeve is seen toward the viewer with the closed side of female snaps 43 and protruding members of male snaps 44 seen in the view. Arcuate top edge 45 and bottom edge 46 are joined by end edges 47 and 48. The inner side of the sleeve is seen at 49 and FIG. 9.

With respect to all of the devices of the figures, the material may be conventional carpeting or two sided carpeting, foam rubber, foam plastic, leather, quilted cloth, inflatable vinyl or the like. Fastening means other than those shown include buttons, zippers, velcro and hook and eye, to name a few of the conventional fasteners which may be employed. With respect to height variations, such could range from a very short distance, such as one and a half inches, to approximately ten inches. That is, there could be very short bed legs or furniture legs which would yet be quite uncomfortable to strike with the toe. A height above the normal swing height of the human foot and step generally does not need to be protected. The diameter of the device assembled would vary, depending upon the warning desire to be given to the foot and the size of the support, leg or foot of the furniture or apparatus to be encircled. Typically two to six inches would be practical. In the case that is it is desired that the users toe be deflected along the upper surface of the device of FIGS. 8 and 9, the slope thereof may be made greater than shown.

Very soft and protective materials may be used on the outside alone, the outside and inside or even just the inside alone, in the case where one's feet might not be expected to contact the outside of the device and it is primarily for the protection of the object encircled. In any case, however, there must be a sufficiently stiff or strong framework or layer to maintain the attached device in direct upright position. Various colors and patterns may be employed as desired. In certain circumstances, flourescent or reflecting materials could be employed for warning purposes on the outside surface. Hems, borders and ruffles or covers to meet design or decorative objectives may be employed. The device itself may be covered by a hem, border or ruffle, as with respect to a bed or a sofa.

Thus it has been seen that I have provided protective sleeves and devices which accomplish all of the objects set forth hereinabove. The devices operate not only to protect the foot of the user, but also the object or leg encircled. They are readily applied and removed according to different circumstances. They are simple, cheap, long lived and rugged.

At 19*a* in FIG. 3 is shown a portion of resilient nap or padding to show either or both side nap or padding.

From the foregoing, it will be seen that this invention is one well adapted to attain all of the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A protective sleeve for enclosing the foot of a normally vertical material object support leg, as well as a portion of the leg above said foot, comprising:

an elongate, substantially rectangular strip of material having relatively longer, substantially parallel and normally substantially horizontal upper and lower edges and relatively shorter, substantially parallel and normally substantially vertical end edges and inner and outer faces, means on said strip adjacent the end edges thereof for releasably engaging the said end edges together to form a continuous, cylindrical sleeve, with the strip outer face on the outside thereof, said strip of sufficient strength, dimensional stability and height to stand on one lower edge thereof on a normally horizontal supporting surface, when the end edges thereof are engaged together, said strip encircling and enclosing the said support leg foot and a portion of said leg thereabove, said strip additionally sufficiently resilient in the body thereof to form a cushion to shock on impact of a contacting object (such as a person's bare foot) striking the enclosed support leg and foot through the strip, said strip further additionally of greater interior dimension then said support leg and any enclosed parts thereof, including its foot, whereby, when the strip is applied around (encircling and partially enclosing) the support leg foot and some of said leg and the end edges thereof engaged together, it normally stands substantially free of said foot and leg, supporting itself and giving an initial foot warning contact to an unexpecting contacting object, independent of the structure of the support leg foot and support leg thereof, before there is any contact by said object with the surrounded leg or foot.

2. A sleeve as in claim 1 including at least one face of the strip itself resilient.

3. A sleeve as in claim 2 wherein said resilient face is the outside face.

4. A sleeve as in claim 2 wherein said resilient face is the inside face.

5. A sleeve as in claim 1 including both faces of the sleeve themselves resilient.

6. A sleeve as in claim 1 wherein said releasable engaging means are positioned adjacent each end of the strip.

7. A sleeve as in claim 1 wherein the strip has a relatively stiffer and denser portion and a relatively softer and more resilient portion, both said portions extending the full area of the strip.

8. A protective sleeve for enclosing the foot of a normally vertical material object support leg, as well as a portion of the leg above said foot, comprising:

an elongate, arcuate strip of material having relatively longer, substantially parallel and normally substantially horizontal arcuate upper and lower edges and relatively shorter, straight, normally diverging and normally substantially vertical end edges and inner and outer faces, and means on said strip adjacent the end edges thereof for releasably engaging said end edges together to form a continuous, frusto-conical sleeve with the strip outer face on the outside thereof, said strip of sufficient strength, dimensional stability, rigidity and height to stand on the lower, longer edge thereof on a normally horizontal supporting surface, when the side ends thereof are engaged together, said strip encircling and partially enclosing said support leg foot and a portion of said leg thereabove, said strip additionally sufficiently resilient in the body thereof to form a cushion to shock on impact of a contacting object (such as a person's bare foot) striking the enclosed support leg or foot through the strip, said strip further additionally of greater interior dimension than said support leg and any enclosed parts thereof (including its foot) in the substantial height thereof whereby, when the strip is applied around (encircling and partially enclosing) the support leg foot and some of said support leg and the end edges thereof engaged together, it normally stands substantially free of said foot and leg, supporting itself and giving an initial foot warning contact to an impacting conting object independent of the structure of the support leg foot and support leg thereabove, before there is any contact by said object with the surrounded leg or foot.

9. A sleeve as in claim 8 including at least one face of the strip itself resilient.

10. A sleeve as in claim 9 wherein said resilient face is the outside face of the sleeve.

11. A sleeve as in claim 9 wherein said resilient face is the inside face of said sleeve.

12. A sleeve as in claim 8 wherein both of the faces of said sleeve are themselves resilient.

13. A sleeve as in claim 8 wherein said releasable engaging means are positioned adjacent each end of the strip.

14. A sleeve as in claim 8 wherein the strip has a relatively stiffer and denser portion and a relatively softer and more resilient portion, both said portions extending the full area of the strip.

* * * * *